US012172096B1

(12) United States Patent
Gallagher et al.

(10) Patent No.: US 12,172,096 B1
(45) Date of Patent: Dec. 24, 2024

(54) FASTENERS FOR TOY CONSTRUCTION PLAYSETS

(71) Applicant: ImaginNoodles, LLC, Lancaster, PA (US)

(72) Inventors: Michael James Gallagher, Lancaster, PA (US); Christopher Gerard Gallagher, Lancaster, PA (US)

(73) Assignee: ImaginNoodles, LLC, Lancaster, PA (US)

( * ) Notice: Subject to any disclaimer, the term of this patent is extended or adjusted under 35 U.S.C. 154(b) by 182 days.

(21) Appl. No.: 18/052,930

(22) Filed: Nov. 6, 2022

Related U.S. Application Data

(60) Provisional application No. 63/381,695, filed on Oct. 31, 2022, provisional application No. 63/276,574, filed on Nov. 6, 2021.

(51) Int. Cl.
*A63H 33/10* (2006.01)
*A63H 33/04* (2006.01)
*A63H 33/00* (2006.01)

(52) U.S. Cl.
CPC ..... *A63H 33/101* (2013.01); *A63H 33/042* (2013.01); *A63H 33/044* (2013.01); *A63H 33/008* (2013.01)

(58) Field of Classification Search
CPC ..... A63H 33/101; A63H 33/108; Y10T 24/44026; F16B 21/082; F16B 21/125; F16B 13/0808
USPC ..... 411/37–38, 344, 345, 347; 446/487–488
See application file for complete search history.

(56) References Cited

U.S. PATENT DOCUMENTS 1,203,669 A * 11/1916 Whiteside ..... F16B 13/0808 411/340
1,656,199 A 1/1928 Hodgson
1,767,745 A * 6/1930 Day ..... G09F 1/10 248/222.12
2,171,648 A * 9/1939 Ennis ..... A47K 10/3836 411/347
2,238,039 A 4/1941 De Witt
2,389,635 A * 11/1945 Place ..... F16B 5/0642 24/453
2,401,976 A * 6/1946 Simpson ..... F16B 21/125 411/514
2,549,459 A * 4/1951 Guest ..... F16B 21/125 411/514

(Continued)

FOREIGN PATENT DOCUMENTS

CA 2164240 A1 6/1997

*Primary Examiner* — Eugene L Kim
*Assistant Examiner* — Matthew B Stanczak
(74) *Attorney, Agent, or Firm* — Brian Roffe

(57) ABSTRACT

Locking fastener for a toy construction playset includes an elongate, unitary body having two parts and a living hinge between the parts extending longitudinally between opposite ends of the body. The parts define an arrowhead tip at both ends when in an expanded state. Each tip is formed by a barb on each part that extends in opposite directions relative to the hinge. There is a flange on each part that extends in opposite directions from the hinge. By manipulating the flanges, the barbs are brought against one another to reduce a size of the tips and bring the tips into an insertion state in which each is insertable into a portal of a component of the toy construction playset, such as a log or a panel each of which preferably includes a row of such portals.

19 Claims, 12 Drawing Sheets

(56) References Cited

U.S. PATENT DOCUMENTS 2,691,242 A 10/1954 Young
2,799,118 A 7/1957 Lullo
3,000,134 A 9/1961 Marini
3,130,822 A * 4/1964 Meyer ..... F16B 5/123 411/908
3,205,611 A 9/1965 Onanian
3,213,745 A * 10/1965 Dwyer ..... F16B 13/06 411/970
3,431,813 A * 3/1969 Johnson ..... F16B 13/14 411/61
3,440,784 A 4/1969 Onjukka
3,456,413 A 7/1969 Fischer
3,651,734 A * 3/1972 McSherry ..... F16B 21/088 411/970
3,676,969 A 7/1972 Moore
3,690,031 A 9/1972 Shinoda
3,699,709 A 10/1972 Schmidt
3,716,939 A 2/1973 Pibet
3,769,772 A * 11/1973 Oetiker ..... A47C 17/64 52/646
3,800,494 A 4/1974 Hall et al.
3,987,579 A 10/1976 Palenik, III
4,057,886 A * 11/1977 Brass ..... B29C 65/602 29/451
4,080,752 A 3/1978 Burge
4,086,014 A * 4/1978 Jalaguier ..... F16B 21/125 24/453
4,104,952 A * 8/1978 Brass ..... A63H 33/101 411/908
4,110,932 A * 9/1978 Brass ..... F16B 19/004 446/86
4,159,592 A 7/1979 Gabriel
4,197,781 A * 4/1980 Giannuzzi ..... F16B 13/061 411/341
4,202,132 A 5/1980 Fischer
4,246,718 A 1/1981 Chatani
4,274,324 A * 6/1981 Giannuzzi ..... F16B 13/12 411/908
4,300,848 A * 11/1981 Waegemann ..... B42F 13/42 402/13
4,372,076 A 2/1983 Beck
4,391,077 A 7/1983 Gless
4,657,458 A * 4/1987 Wollar ..... F16B 37/043 411/64
4,704,057 A * 11/1987 McSherry ..... F16B 13/0808 411/344
4,742,033 A 5/1988 Harris et al.
4,755,141 A 7/1988 Nakai
4,860,410 A * 8/1989 Voller ..... F16B 13/0808 24/453
4,878,790 A * 11/1989 McSherry ..... F16B 13/0808 411/340
5,028,186 A * 7/1991 McSherry ..... F16B 13/0808 411/908
5,199,919 A 4/1993 Glickman
5,253,458 A 10/1993 Christian
5,281,185 A 1/1994 Lee
5,366,332 A * 11/1994 Murphy ..... F16B 5/0642 411/908
5,372,450 A 12/1994 Blodgett
5,791,845 A * 8/1998 Fulop ..... F16B 13/124 411/908
5,857,819 A * 1/1999 Lary ..... F16B 21/125 411/530
5,881,515 A 3/1999 George
5,929,906 A 7/1999 Arai et al.
6,074,144 A * 6/2000 Meyer ..... F16L 3/223 411/41
6,595,825 B1 7/2003 De Wilde
6,652,206 B2 * 11/2003 Heflin ..... F16B 19/1081 411/908
6,931,803 B1 8/2005 Davis et al.
6,938,966 B1 9/2005 Rouwhorst
6,964,593 B1 11/2005 Stevens
7,364,440 B2 4/2008 Gobron et al.
7,669,324 B2 3/2010 Daito
8,074,418 B2 * 12/2011 Thiagarajan ..... E04D 3/28 52/590.3
8,475,226 B2 7/2013 Comfort
8,567,149 B2 10/2013 Kuzmin
8,662,328 B2 3/2014 Boisvert
8,671,640 B1 3/2014 Thomas
8,850,683 B2 10/2014 Haughey et al.
8,864,546 B1 10/2014 Capriola
8,961,259 B2 2/2015 Maggiore et al.
9,033,761 B2 5/2015 Azmani
9,238,179 B2 1/2016 Carpenter
9,377,042 B2 6/2016 De Wilde
9,399,177 B2 7/2016 Cohcella
9,458,872 B2 10/2016 Nelson
9,737,825 B2 8/2017 Donohoe
9,789,417 B2 10/2017 Vandoren
9,814,998 B2 11/2017 Nei
10,130,894 B2 11/2018 Peller
10,183,229 B2 1/2019 Donohoe
10,272,353 B2 4/2019 Oh
10,398,999 B2 9/2019 Cochella
10,493,371 B2 12/2019 Cochella et al.
10,518,193 B2 12/2019 You
10,526,783 B2 1/2020 Hon
2003/0024187 A1 2/2003 Wilt
2003/0036333 A1 2/2003 Oakley
2003/0049992 A1 3/2003 Leemon
2004/0244158 A1 * 12/2004 Awakura ..... F16B 5/0642 24/458
2007/0218801 A1 9/2007 Weinshanker
2008/0142670 A1 * 6/2008 Cvelbar ..... F16B 21/082 248/544
2008/0196222 A1 * 8/2008 Park ..... F16B 5/0614 403/291
2009/0301012 A1 12/2009 Stein
2010/0009593 A1 1/2010 Hottl
2010/0011686 A1 1/2010 Stein
2010/0151765 A1 6/2010 Kwak et al.
2010/0210172 A1 8/2010 Worthington et al.
2010/0273388 A1 10/2010 Carlson et al.
2012/0020726 A1 * 1/2012 Jan ..... F16B 5/0642 403/330
2012/0184174 A1 7/2012 Kwak et al.
2013/0095722 A1 4/2013 Cochella
2013/0330998 A1 12/2013 Fox et al.
2014/0273712 A1 9/2014 Uttley et al.
2015/0247328 A1 9/2015 Correia et al.
2015/0375132 A1 12/2015 Cheung
2016/0136536 A1 5/2016 Ben Shalom
2016/0160515 A1 6/2016 Wallance
2016/0310864 A1 10/2016 Cheung
2018/0117488 A1 * 5/2018 Gallagher ..... A63H 33/3072
2018/0118488 A1 5/2018 Suzuki et al.
2018/0177488 A1 5/2018 Gallagher
2018/0296938 A1 * 10/2018 Gallagher ..... A63H 33/101
2018/0296983 A1 10/2018 Dacey, Jr. et al.
2020/0038772 A1 2/2020 Wong et al.
2020/0054957 A1 2/2020 Chan et al.
2020/0054958 A1 * 2/2020 Gallagher ..... A63H 33/101
2020/0282322 A1 9/2020 Gallagher
2021/0131096 A1 * 5/2021 Mordechai ..... E04B 1/32

* cited by examiner

FASTENERS FOR TOY CONSTRUCTION PLAYSETS

CROSS-REFERENCE TO RELATED APPLICATIONS

This application claims priority of U.S. provisional patent application Ser. No. 63/276,574 filed Nov. 6, 2021, and U.S. provisional patent application Ser. No. 63/381,695 filed Oct. 31, 2022, both of which are incorporated by reference herein.

FIELD OF THE INVENTION

The present invention relates generally to fasteners for toy construction playsets and more particularly to fasteners for toy construction playsets that are easy to use and provide a secure attachment of adjacent components of the playset to one another, or possibly two parts of the same component. The present invention also relates to toy construction playsets including lightweight logs and other building components made of expanded plastic foam, such as polyethylene or polyurethane, and fasteners to enable attachment of the logs and other building components to one another in numerous and varied forms. Even more particularly, the present invention relates to toy construction playsets and soft, creative environments that can be built to tower above a child's head without concern of injury due to collapse.

The present invention also relates generally to toy construction playsets with one-piece molded fasteners to hold toy construction flexible substrates together that are large enough to pass the toy industry's Small Part Gauge.

BACKGROUND OF THE INVENTION

Children's blocks have forever been a source of creative play. Frank Lloyd Wright, Charles Eames, Buckminster Fuller and other thought leaders famously credit their childhood blocks as a valuable educational resource from their early youth and/or a significant outlet for their creative minds from a very early age. While playing with blocks is often an immersive experience, few sets of blocks allow for the construction of structures that are full size play sets. The risk of such a structure falling on a child has typically prevented this scale of immersive play set.

The blocks are great for inside or outside play. While the playset of blocks is designed for the real world, a computer-based playset for the computer world is one option. In this way, children can plan their designs on the computer, make them in the real world and play with them in either environment.

Children also have access to toy construction playsets including expanded plastic foam noodles that are hollow custom extrusion profiles resembling logs, and hereinafter referred to as "foam logs" or "logs". These logs are often connectable to each other with the use of fasteners designed to engage adjacent logs in a secure manner.

The inventor has several prior applications directed to logs and related products, including, U.S. patent application Ser. No. 15/344,333 filed Nov. 4, 2016, Ser. No. 15/951,199 filed Apr. 12, 2018, Ser. No. 16/664,891 filed Oct. 27, 2019 and Ser. No. 16/884,258 filed May 27, 2020, all of which are incorporated by reference herein.

OBJECTS AND SUMMARY OF THE INVENTION

It is an object of at least one embodiment of the present invention to provide new and improved fasteners for toy construction playsets, toy construction playsets including such fasteners, and methods for using such toy construction playsets.

It is another object of at least one embodiment of the present invention to provide new and improved one-piece molded fasteners to hold foam toy construction flexible substrates together, toy construction playsets including such fasteners, and methods for using such toy construction playsets.

It is another object of at least one embodiment of the present invention to provide molded fasteners for toy construction logs that are connectable to each other and which compress to pass easily through holes or portals in walls of each of a pair of adjacent logs or other toy construction playset components.

It is another object of at least one embodiment of the present invention to provide a toy construction playset that is full size.

It is another object of at least one embodiment of the present invention to provide a full size toy construction playset that eliminates the risk of injury from falling pieces or injuries to children jumping off structures formed by the playset.

It is another object of at least one embodiment of the present invention to provide a building system for children that allows them to construct structures from hollow foam extrusions or foam logs that are stackable so they can make playsets of their own design or existing designs in which they can hide, play, and let their imaginations soar.

The importance of a one-piece fastener construction cannot be underestimated in that it allows everyone and in particular small children to use the fasteners while not requiring minimal dexterity needed to align and manipulate small parts such as nuts and bolts and other two piece fastening systems. One-piece plastic fasteners also allow for low-cost fabrication so the toys are affordable. All described fasteners are of the size that should pass the Children's Choke Gauge safety standard.

In order to achieve one or more these objects and/or others, a fastener for a toy construction playset in accordance with the invention includes an elongate, unitary body having two parts and a living hinge between the parts extending longitudinally between opposite ends of the body. The parts define an arrowhead tip at at least one end and preferably both ends when in an expanded state. The tip is formed by a barb on each part that extends in opposite directions relative to the hinge. There is a flange on each part that extend in opposite directions from the hinge. By manipulating the flanges, the barbs are brought against one another to reduce a size of the tips and bring the tips into an insertion state in which each is insertable into a respective portal of a component of a toy construction playset.

The two parts may be mirror-image parts, and the body made of plastic. The barbs may have a triangular shape including an angled wall facing the end of the body at which the barb is located, a bottom wall facing an opposite end of the body and a wall alongside the hinge. The angled wall is designed to contact the edge of the portal and guide or ease the insertion of the barbs into the portal. The body may include two elongate walls, one in each part, and which are separated from one another to define a channel therebetween with the hinge being at a bottom of the channel. The parts are pivotable about the hinge to bring the walls of the parts to a position against one another, i.e., into the insert state or position. The flanges extend axially from a respective wall defining the channel along the spine of the body. The flanges are in an approximate middle region of each of the parts.

A toy construction playset in accordance with the invention includes at least one log or panel having a plurality of portals, and one or more fasteners as described above. There may thus be a single log which is attached to itself by the fastener, e.g., bent over, or a log and a panel which are secured to one another, or two panels. By using multiple logs and panels and fasteners, there is virtually no limit to the number of forms that can be made using the playset of the invention.

A method forming a construction of a toy construction playset in accordance with the invention includes providing at least one component having portals, and preferably a plurality of logs and panels, providing one or more fasteners, each as described above, manipulating the flanges of the fasteners to approach one another to cause the barbs to be brought against one another and reduce a size of the tips and bring the tips into an insertion state; inserting the tips, when in the insertion state, into a respective one of the portals of the component or component to be secured and locked together, and then moving the flanges away from one another to cause the barbs to separate from one another and the tips to re-form, whereby removal of the fastener from the portals is prevented by the tips.

The following embodiments and aspects thereof are described and illustrated in conjunction with systems, tools and methods which are meant to be exemplary and illustrative, but not limiting in scope. In various embodiments, one or more of the above-described problems have been reduced or eliminated, while other embodiments are directed to other advantages or improvements.

A better understanding of the disclosed technology will be obtained from the following detailed description of the preferred embodiments, taken in conjunction with the drawings and the attached claims.

BRIEF DESCRIPTION OF THE DRAWINGS

Some embodiments of the invention are described herein with reference to the accompanying figures. The description, together with the figures, make apparent to a person having ordinary skill in the art how some embodiments may be practiced. The figures are for the purpose of illustrative description and no attempt is made to show structural details of an embodiment in more detail than is necessary for a fundamental understanding of the invention. For the sake of clarity, some objects depicted in the figures are not to scale.

DETAILED DESCRIPTION OF THE INVENTION

Figure 1:
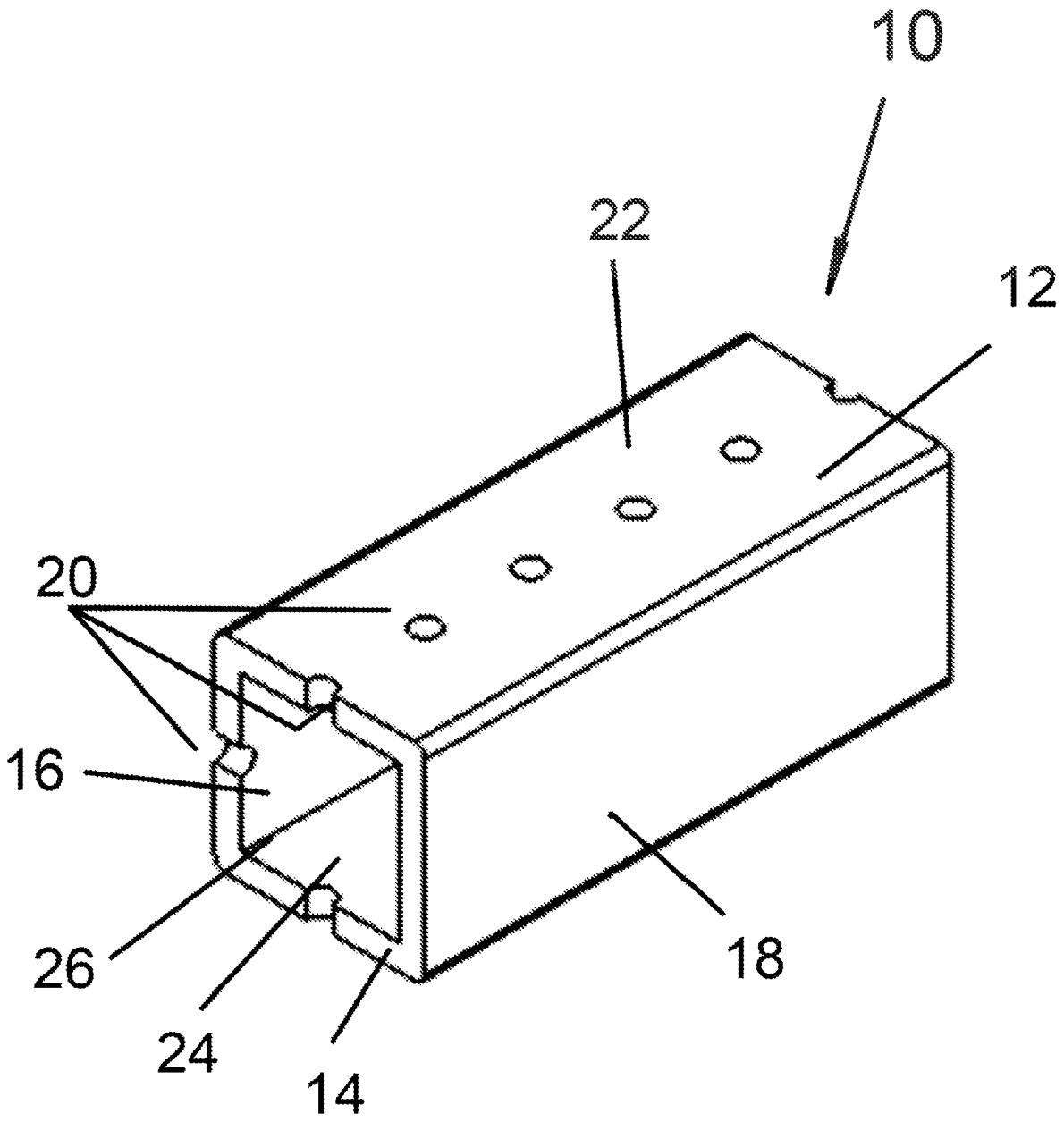
FIG. 1 is a perspective view of a log used in a playset in accordance with the invention and with a fastener in accordance with the invention.

The ensuing detailed description provides explanation of various aspects of the disclosed technology. The purpose of this explanation is to provide a thorough understanding of the different aspects of the disclosed technology. This description is not intended to limit the scope, applicability, or configuration of the disclosed technology. It will also be apparent to one skilled in the art that the disclosure may be practiced without specific details being presented herein. Various changes may be made in the function and arrangement of elements without departing from the spirit and scope of the disclosed technology as set forth in the appended claims. Furthermore, well-known features may be omitted or simplified for clarity.

To aid in describing the describing the disclosed technology, directional terms may be used in the specification and claims to describe portion of the present technology (e.g., upper, lower, left, right, etc.) These directional definitions are merely intended to assist in describing and claiming the disclosed technology and are not intended to limit the disclosed technology in any way. In addition, reference numerals that are introduced in the specification in association with a drawing figure may be repeated in one or more subsequent figure without additional description in the specification, in order to provide context for the other features.

The terms "noodle", "log" and "block" as used herein are interchangeable. A log for purposes of this disclosure is defined as an elongated, hollow tube or cylinder optionally with two or more flattened exterior sides. The flattened sides allow the logs to be easily stacked like logs in a log cabin. The logs are made of the same material as foam "pool noodles". The logs can have a larger diameter than most pool noodles with three relatively flat sides each with holes or portals and a fourth side that is flat or optionally curved with no holes so playsets appear to be made from large foam logs.

The term "substantially flat planar surface" as used herein is defined as a flat section along the length of the side of a log and from 25 percent to 100 percent of the width of a side of the log.

The term "fixed" connection as used herein is defined as one which is expected to or does cause damage to one of the parts described when removed.

The term "removable" as used herein is defined as able to connect and disconnect repeatedly (>6 times) without causing damage to a connector piece or parts being connected.

The term "pivoted" as used herein is defined as a linkage that allows at least one degree of freedom of movement similar to a hinge between connected logs or parts.

Expanded polyethylene extrusions provide a lightweight, soft, structural material that can allow children to safely build play structures of their own imaginations that reach over their heads without concern of injury. The blown polyethylene hollow extrusions interlock with simple connector designs that allow a child to assemble log cabins, forts, castles, boats, and other imaginative structures quickly and easily with no tools other than a toy saw, if desired.

Referring to FIG. 1, a log 10 of blown or extruded plastic is included in a construction playset according to the invention and has top wall 12, a bottom wall 14, a left side wall 16 and a right side wall 18. Three of the walls, e.g., the top, bottom, and left side walls 12, 14, 16, include holes or portals 20. There may be a row of such portals 20 along only part of or along the entire longitudinal extent or length of the log 10. The portals 20 extend entirely through the respective wall 12, 14, 16 from the outer surface 22 of the log 10 to the inner surface 24 of the log 10. The inner surface 24 defines a hollow interior 26 of the log 10. The top, bottom, left and right walls 12, 14, 16, 18 may have a substantially flat planar outer surface or be curved. Also, it is not required that three of the walls include portals 20, and any number of the walls 12, 14, 16, 18 may include portals 20, whether one, three or all four. The dimensions of the log 10 may be varied as desired, e.g., its length and the width and thickness of the walls 12, 14, 16, 18. It is also possible to form the logs 10 with any number of walls and not necessarily four discrete walls. The disclosed logs 10 do not in any limit the use of the fasteners disclosed herein.

The logs 10 may define a hollow circular, square, rectangular, triangular, or other shaped extruded foam profiles.

Figure 2:
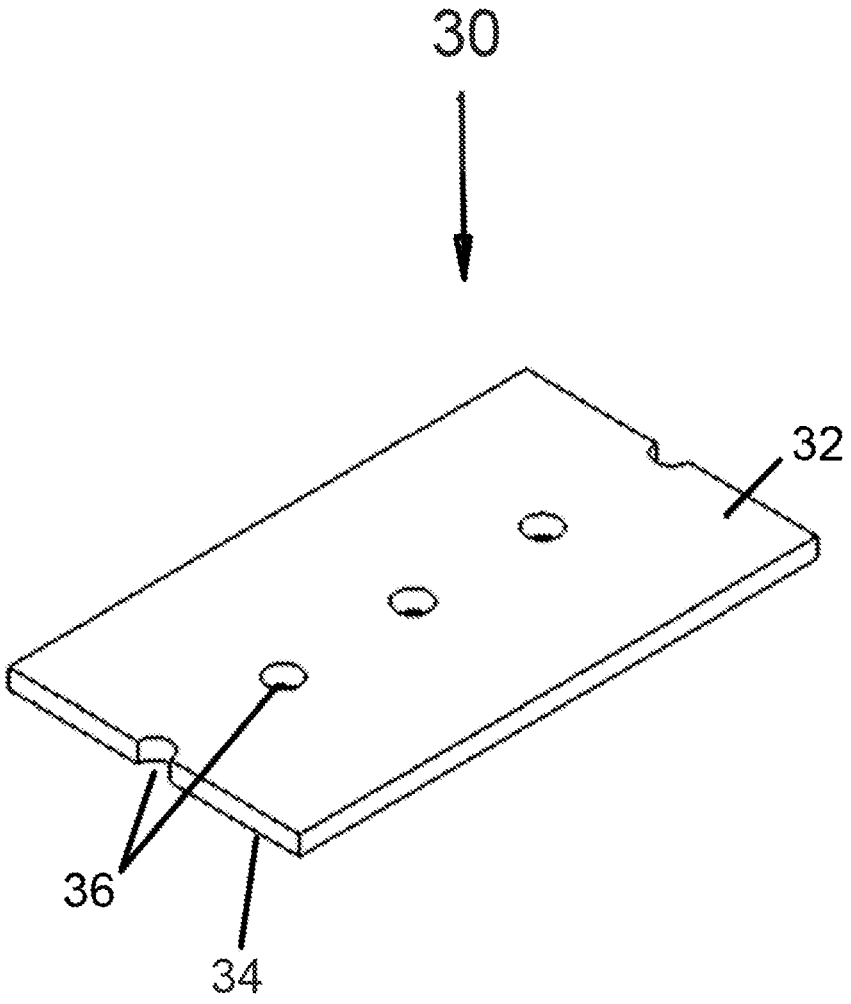
FIG. 2 is a perspective view of a panel used in a playset in accordance with the invention and with a fastener in accordance with the invention.

Instead of or in addition to one or more logs 10, a construction playset in accordance with the invention may include a panel 30 as shown in FIG. 2. Panel 30 includes upper and lower substantially flat planar surfaces 32, 34 and portals 36. There may be a row of such portals 36 along only part of or along the entire longitudinal extent or length of the panel 30. The portals 36 extend entirely through the panel 30 from the outer surface upper surface 32 to the lower surface 34. The dimensions of the panel 30 may be varied as desired, e.g., its width, length, and thickness. Panel 30 may also be curved.

The logs 10, panels 30 and possibly other substrates may be assembled and will stay together until a child or parent deliberately disassembles them. Fasteners and locking elements are used in portals formed in, or subtracted from, the foam extrusion.

Logs 10 made of plastic foam extrusions provide a lightweight, soft, structural material that allows children to safely build and play in structures of their own imaginations, even if those structures reach well over their heads. The foam extrusions provide both structure and strength without causing concern for injuries should the structure fall on a child. The foam logs are held together with a series of fasteners that are removable, discussed below. These fasteners allow a child to assemble foam logs into cabins, forts, castles, boats, and other imaginative structures quickly and easily with no tools other than possibly a toy miter and toy saw. The locking fasteners provide a greater interference fit with the logs than other removable fasteners so the structures will stay together better where the standard fasteners might pop out.

In some situation such as a swimming pool, using a locking fastener in accordance with the invention, children can construct playsets that do not come apart accidentally. The locking fasteners are inserted in a similar way as prior art fasteners but the fastener opens to create a greater interference fit with the foam substrates.

FIGS. 3-9 shows a first embodiment of a locking fastener 40 in accordance with the invention that can be used to connect two logs 10, two panels 30 or one log and one panel 30 together, or any other components together or possibly even the same component at two locations. Indeed, the same locking fastener 40 can be used to connect other components of a playset in accordance with the invention together, such as those disclosed in the inventor's earlier filed applications mentioned above. This locking fastener 40 is designed to be very easy for children to use.

Figure 8:
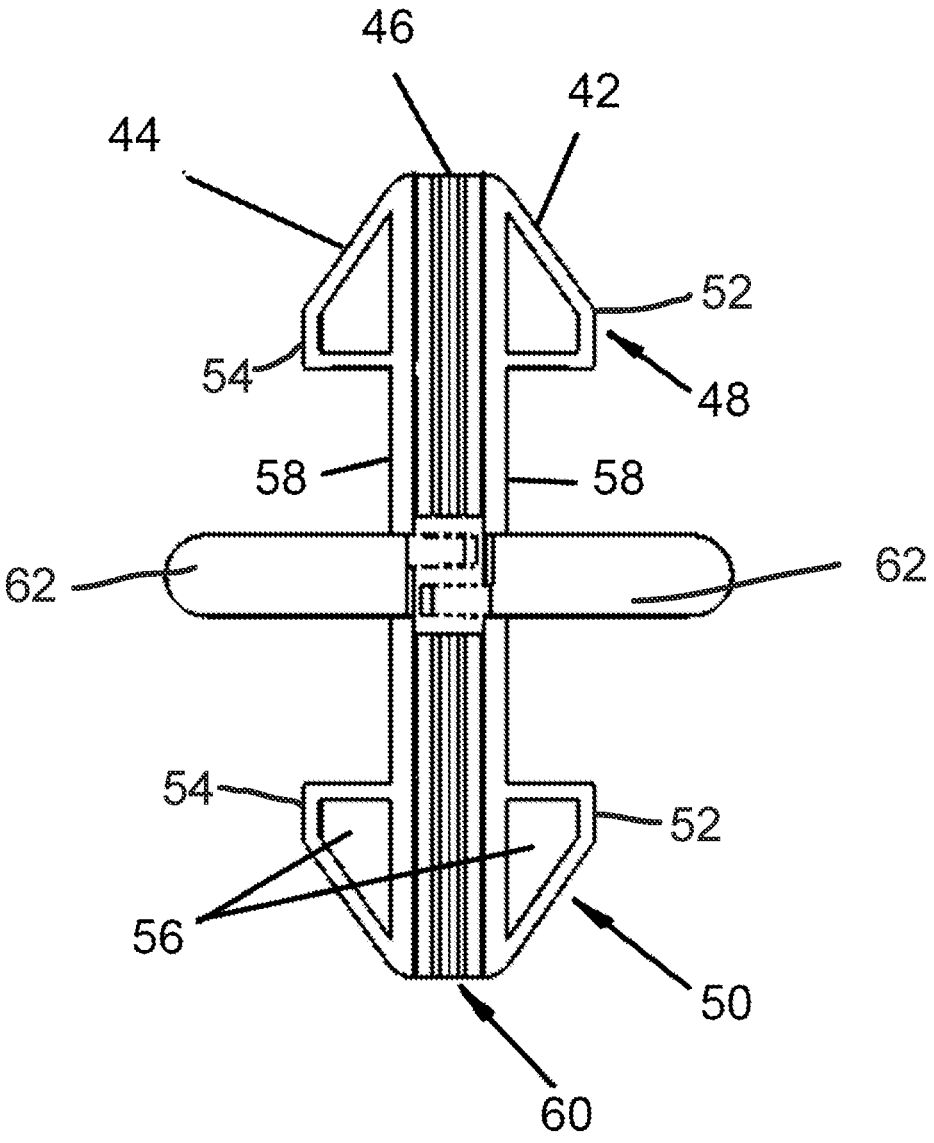
FIG. 8 is a rear view of the fastener of FIG. 3.
Figure 9:
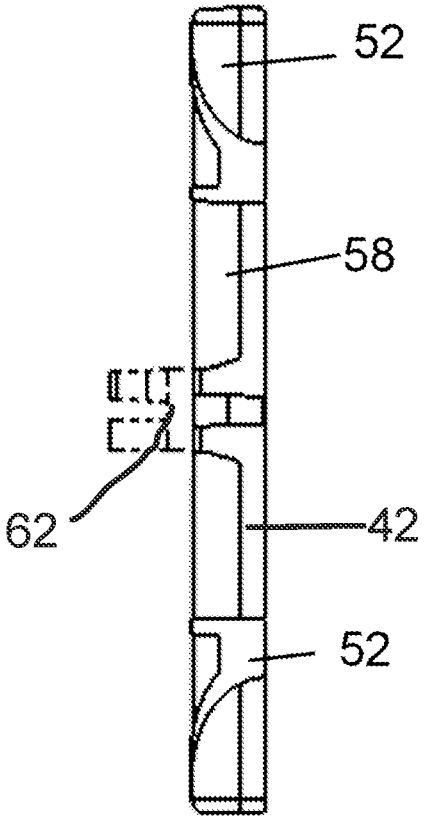
FIG. 9 is a left side view of the fastener of FIG. 3.

Locking fastener 40 includes a unitary body made of two parts 42, 44 connected via a living hinge 46 extending in a longitudinal direction of the fastener 30, i.e., from the top to the bottom in a longitudinal center of the fastener 40 (see FIG. 8). The parts 42, 44 may be identical halves or mirror image halves. The hinge 46 can have a biased or preferential position and as such, it often referred to as a "butterfly hinge" in injection molding. By unitary, it is meant that the fastener 40 is made of a single component or member, i.e., it has a unibody construction.

The hinge 46 is a plastic hinge and is living in the sense as known in the trade because it is molded in a single piece with the parts 42, 44, allowing the two parts 42, 44 to pivot about that hinge 46 in order to separate arrowhead tips 48, 50 at the top and bottom ends of the fastener 40. This separation is used to enable the tips 48, 50 to pass through one of the portals 20, 36 in the log 10 or panel 30, after which the tips 48, 50 revert to their arrowhead shape which makes the fastener 40 wider and much more difficult to remove from the log 10 and/or panel 30. Insertion of the fastener 40 into a log 10 is discussed with reference to FIGS. 10-12.

Although various forms of the hinge 46 are possible, in one embodiment, the hinge 46 is configured to enable it to be opened beyond 30 degrees. In essence, taking the hinge 46 as a fixed point, each part 42, 44 is pivoted relative to the hinge 46 about 90 degrees. Thus, while the rear wall of the body of the fastener 40 is continuous when the fastener 40 is in the expanded state (see FIGS. 5 and 12), in the folded state, the rear walls of the parts 42, 44 of the body are against and possibly in contact with one another (see FIG. 10).

Each tip 48, 50 includes one section or barb 52, 54 on each part 42, 44. The barbs 52, 54 extend in opposite directions from the hinge 46. The barbs 52, 54 have an opening 56 through which a string may be passed. Each barb 52, 54 has a generally triangular shape in that it has a bottom wall facing the other end of the fastener 40 and an angled wall facing the end of the fastener 40 at which the barb 52, 54 is located, with the third side of the barb 52, 54 being an elongate wall 58 running along the part 42, 44 from the top to the bottom end. A channel 60 is formed between the walls 58 with the hinge 46 being in the middle of this channel 60.

Channel 60 is essentially U-shaped with the hinge 46 in the approximate middle of the bottom of the U-shape and the walls 58 being the sides of the U-shape. The rear surface portions of the bottom wall on opposite sides of the hinge 46 are brought into contact with one another in the insertion state (see FIG. 10). These rear surface portions then separate from one another as the fastener 40 is returned to its locking state (see the progression from FIG. 10 to FIG. 11 and then to FIG. 12).

Figure 3:
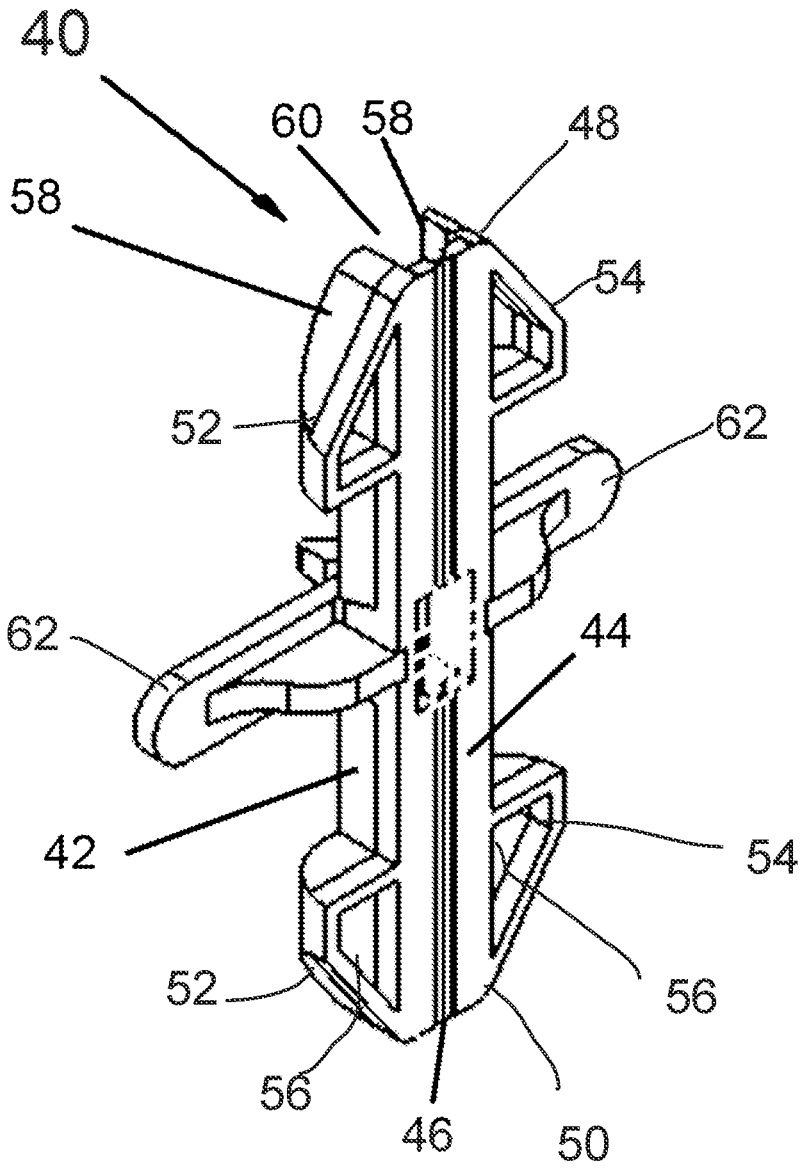
FIG. 3 is a front perspective view of a first embodiment of a fastener in accordance with the invention.
Figure 4:
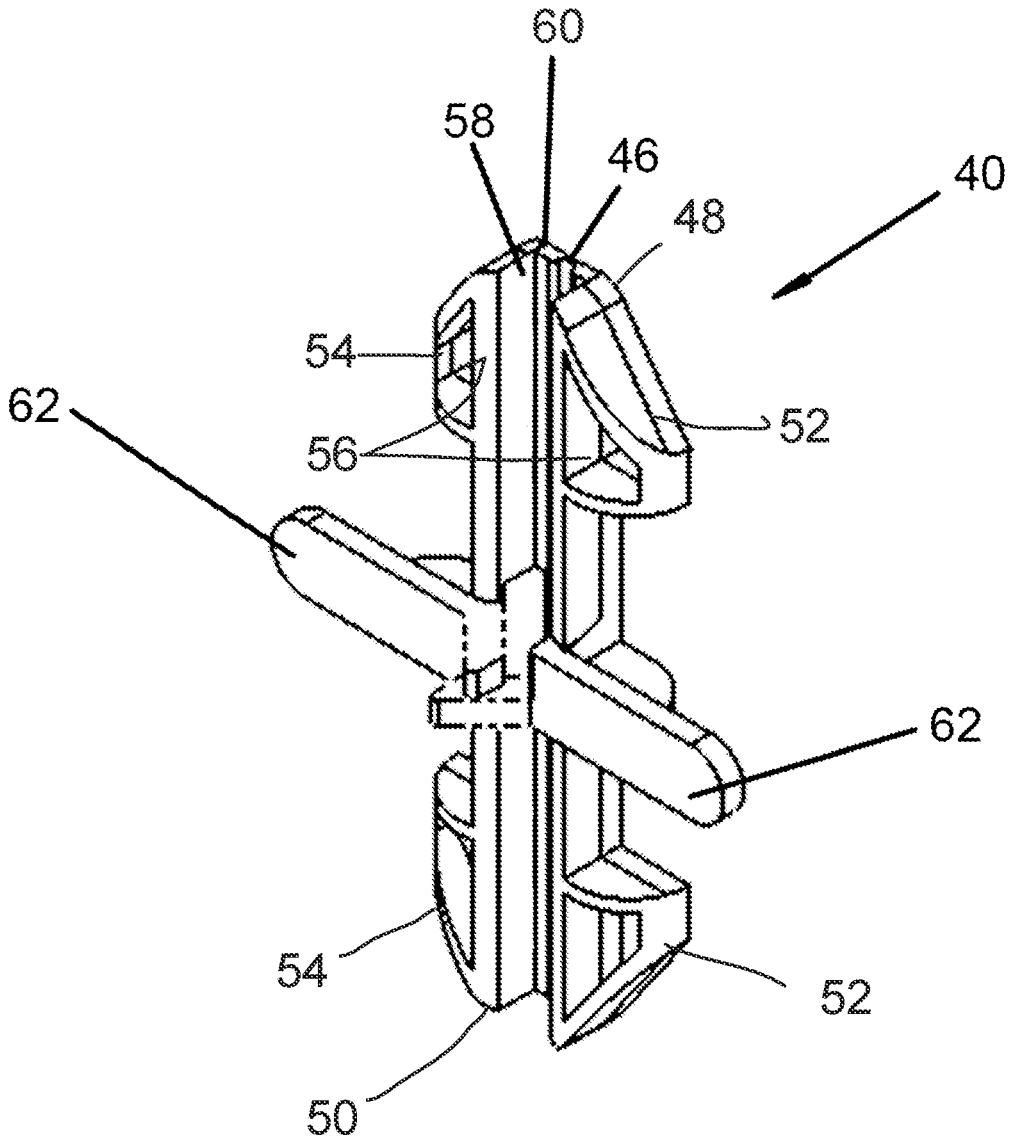
FIG. 4 is a rear perspective view of the fastener of FIG. 3.
Figure 5:
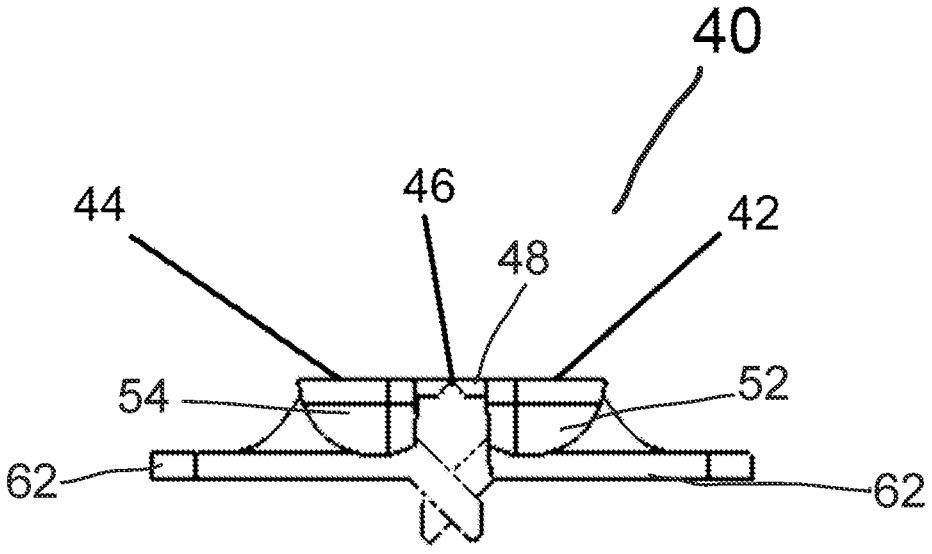
FIG. 5 is a top view of the fastener of FIG. 3, the bottom view being a mirror image thereof.
Figure 6:
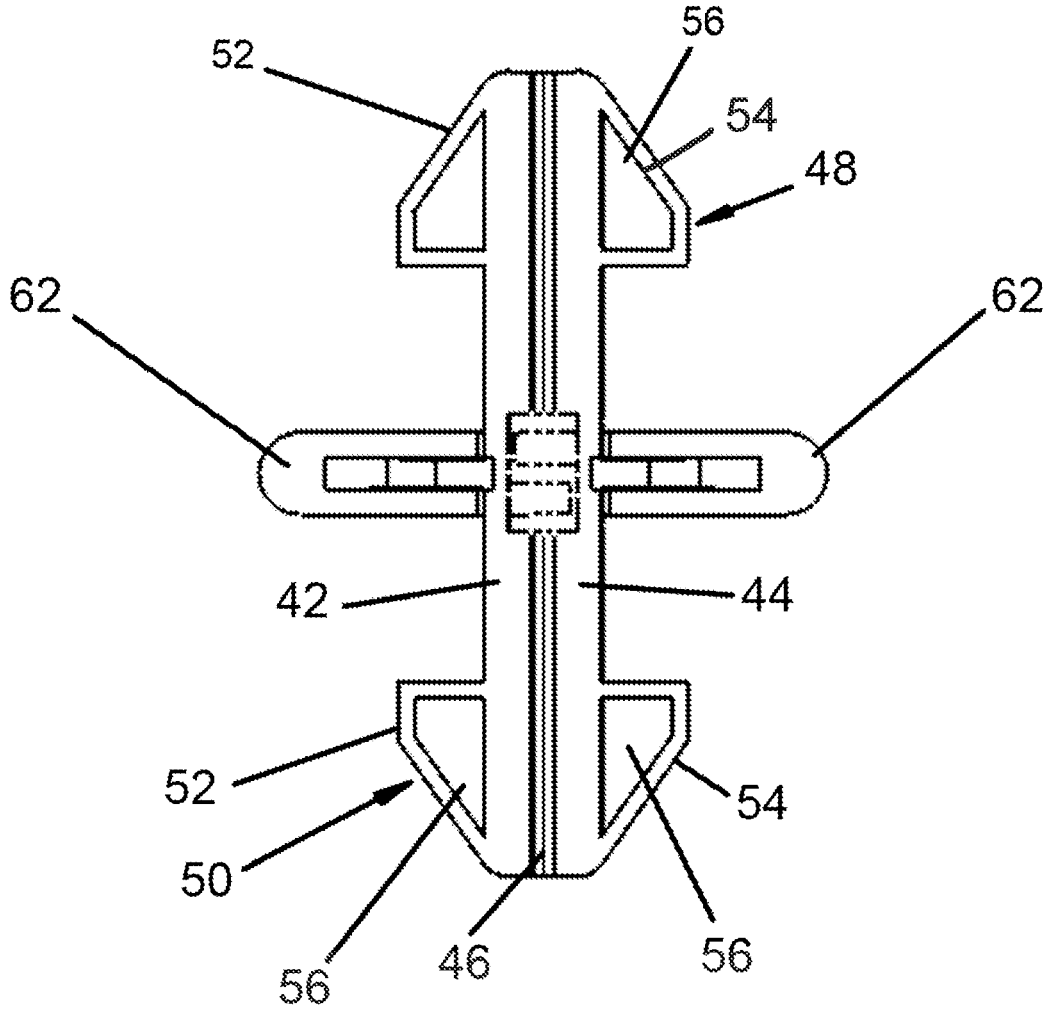
FIG. 6 is a front view of the fastener of FIG. 3.
Figure 7:
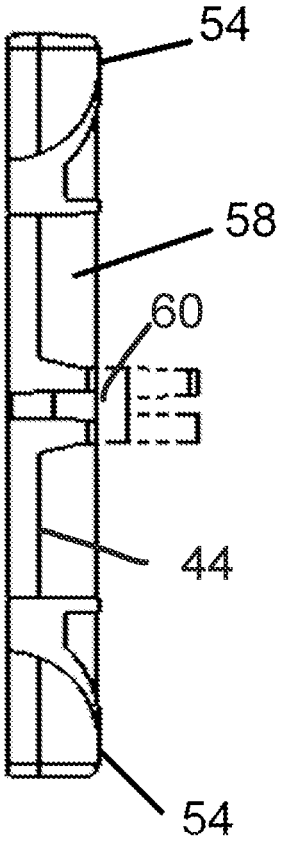
FIG. 7 is a right side view of the fastener of FIG. 3.

The angled wall at a front end facilitates insertion of the arrowhead tips 48, 50 into a portal 20, 36 when contacting the surface defining the portal 20, 36 in the log 10 or panel 30, while the undercut bottom wall prevents removal of the barb 52, 54 from connection with the log 10 or panel 30. As seen in FIGS. 3 and 4, the barbs 52, 54 have a lightly curved shape.

In view of the presence of the hinge 46, it is possible to bring the barbs 52, 54 together to form the arrowhead tips 48, 50 by pivoting the barbs 52, 54 together about the hinge 46 thereby causing the tip 48, 50 to be about half as wide as the barbs 52, 54 when in their extended state, as seen best in FIGS. 3-6 and 8).

Fastener 40 is preferably a single piece of plastic that has the molded-in hinge 46 allowing the two parts 42, 44 to fold and open relative to each other when manipulated by paddles or flanges 62 on either side of the fastener 40. There is one flange 62 on each part 42, 44 in an approximate middle region of the part 42, 44 and which extend axially outward from the wall 58. The size and shape of the flanges 62 is not important as long as there is sufficient material to enable the flanges 62 to be grasped to enable closure of the fastener 40 by rotating the flanges 62 relative to the hinge 46 in one direction, and also preferably opening of the fastener 40 by rotating the flanges 62 relative to the hinge 46 in the opposite direction.

These flanges 62 remain outside the logs or substrates being fastened together, i.e., between the two logs or two locations on the same log where the fastener 40 is situated. The fastener 40 acts between two foam extrusions, i.e., the logs, with portals 20, 36 in them. The location and shape of the flanges 62 is not important, only that they have a construction to enable a user, including and in particular, small children, to press them together to cause the separation of the tips 48 50 into the barbs 52, 54, i.e., to bring the two barbs 52, 54 together about the hinge 46 for the insertion procedure by bringing the flanges 62 into an adjacent and possibly contact position, and also to separate them from the position in which they are together or adjacent one another to cause the re-formation of the tips 48, 50 from the barbs 52, 54, i.e., to bring the two barbs 52, 54 apart for the locking procedure by bringing the flanges 62 into their separate position extending in opposite directions from the hinge 46.

Fastener 40 can therefore pivot about the hinge 46 in order to separate arrowhead tips 48, 50 into their respective barbs 52, 54 prior to and for insertion into the portals 20, 36 and then the fastener 40 is returned to its original geometry after passing through the portal 20, 36 making the fastener 40 wider and much more difficult to remove from the log 10 or panel 30. This return to its original geometry typically requires manipulation of the flanges 62 to separate from one another to bring them into their fullest separated position. This manipulation may be pivoting of the flanges 62 or more generally the two parts 42, 44 away from one another. The arts 42, 44 may be pivoted away from one another by manipulating the flanges 62 or other location of the parts 42, 44.

Fastener 40 has a design that allows for greater engagement when deployed than the prior art fasteners. This greater engagement is needed, for example, in a water environment such as a pool, or in high wind conditions where the forces that act to separate the foam logs are much greater than just the air in a bedroom for example. This fastener 40 relies on a hinge to pivot about or rotate around in order to function.

Variants are possible. For example, in order to reduce the stiffness of the hinge 46, it is possible to provide one or more openings between the parts 42, 44 where the hinge 46 would be if it were continuous between the top and bottom edges of the fastener 40. An exemplifying opening is shown in dotted lines in FIG. 4. Another variant is to provide protrusions extending rearward from the flanges 62 which can assist in the separation of the barbs 52, 54 from their adjacent position and return of the fastener 40 after insertion into a portal 20, 36 to its original state into the locking state (these protrusions are also shown in dotted lines in FIGS. 3 and 4). Another variation is to form the hinge 46 so that it snaps into the locked position. With an appropriate construction, bending a hinge slightly can make it hold a particular desired position when opened.

Figure 10:
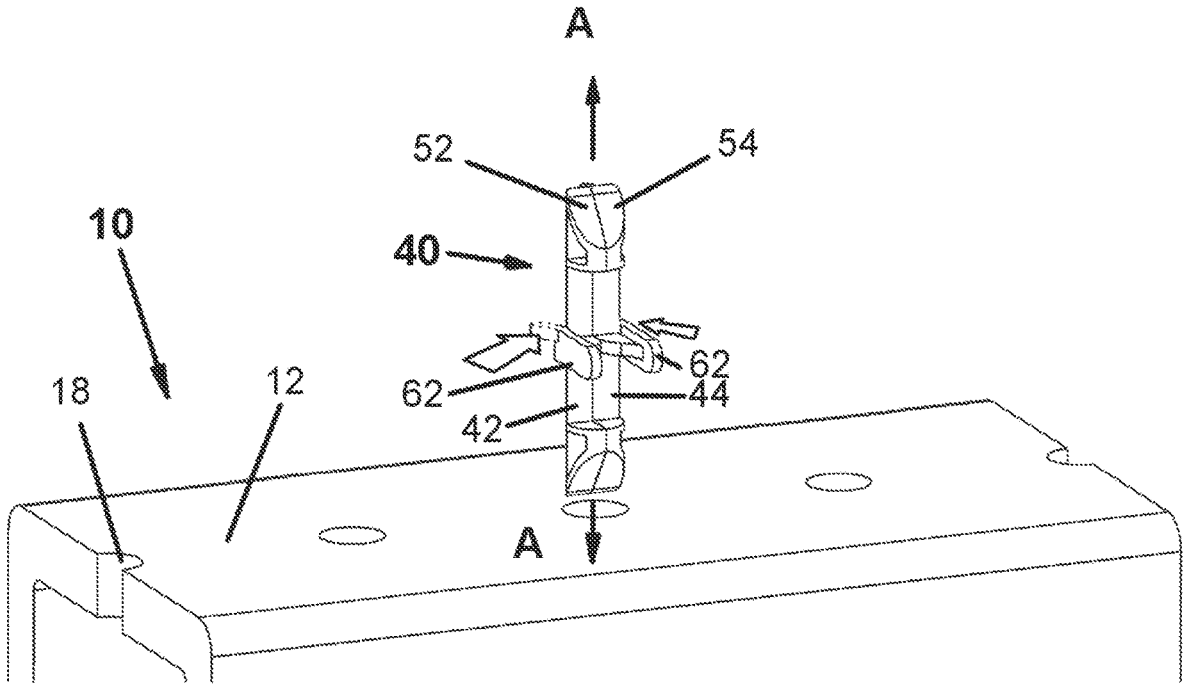
FIGS. 10-12 show the manner in which the fastener of FIGS. 4-8 is inserted into a portal in a log.
Figure 11:
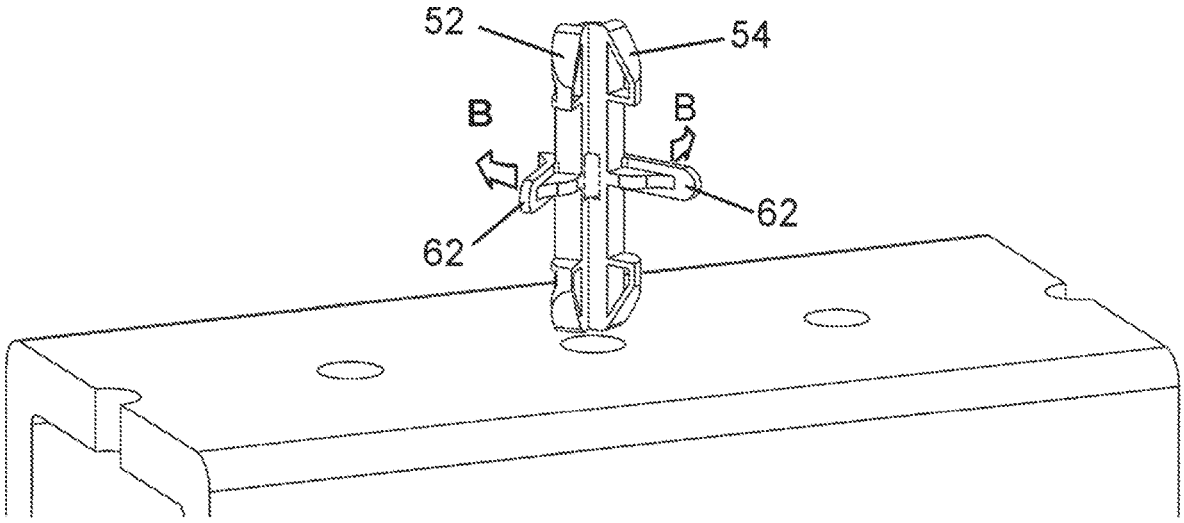
Figure 12:
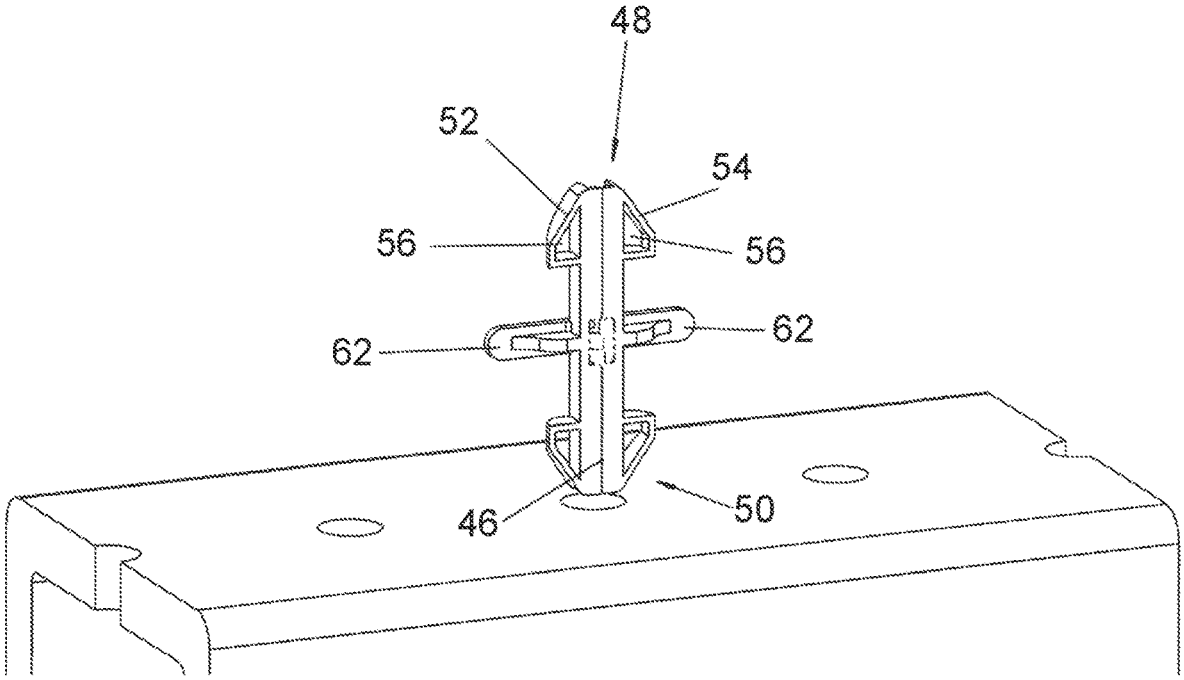

FIGS. 10-12 show the manner in which fastener 40 is inserted into the portal 20 in the log 10. As shown in FIG. 10, the fastener 40 is bent outward by holding the flanges 62 between the user's finger and bringing the fastener 40 into the folded, or closed insert position. By outward, it is meant that the walls 60 are distanced from one another or that the rear wall of the parts 42, 44 are brought against one another. When held in this insert position, the tip 48, 50 at one or both ends of the fastener 40 can be easily slid or inserted into a respective portal 20, 36 in the direction of arrows A.

Once inserted, the flanges 62 are separated from one another causing them to move in the direction of arrows B in FIG. 11. The rear walls of the parts 42, 44 are separate from one another, pivoting apart relative to the hinge 46. This causes the barbs 52, 54 to move apart from one another.

This movement continues until the barbs 52, 54 reach the position shown in FIG. 12 in which the tips 48, 50 re-form. The two barbs 52, 54 separate from one another so there is a barb 52, 54 in each direction away from the hinge 46, making the tip 48, 50 twice as wide as it was when it was inserted. This position is the original, at rest position of the fastener 40. In this "locked" position, the fastener 40 cannot be removed from the log 10.

This "locked" position refers to how well the fastener 40 holds two foam logs 10 or substrates together based on the geometry of the open fastener 40 inside two portals 20 in the foam logs 10 or other substrates. The fastener 40 itself does not lock or unlock, although a curved axis of rotation can be used to have the fastener 40 favor an open geometry and a closed geometry more than a partially deployed position such as that shown in FIG. 11.

In this open position, the fastener 40 cannot be easily inserted or removed from a portal 20, 36 in the log 10 because the portal 20, 36 is intentionally formed to be only wide enough to accept the parallel shaft of the fastener 40 (when in the position shown in FIG. 10). The tips 48, 50 at either end of the fastener 40 can thus fasten two foam logs 10 together (or the same foam log to its own portal further down the log) and remain fastened together until the fastener 40 is deliberately folded and removed from the portals.

Using the logs 10 and fasteners 40, one can build a log cabin by stacking logs 10 at right angles using connectors 40 alone. Logs 10 are cut to size in order to fit, if necessary. Other items such as castles and sailing ships can also be built. Log cabins, forts, castles, and boats are built quickly and easily assembled with no tools, except optionally a toy saw to cut the logs 10.

Playsets in accordance with the invention may allow for inside, outside and water-play, allowing children to build their own designs with a soft material that can be cut, bent, and fastened together to create a wide range of entertaining playsets. This playset or toy provides children not only excitement during the construction phase, but also a durable, imaginative educational toy that withstands rain, wind, and intense sunlight just like existing rotomolded playhouses because the foam logs are also made of polyethylene exactly like the rotomolded products. This toy allows children to develop by thinking three dimensional thoughts creating and building playsets with soft, large diameter foam extrusions.

This toy dramatically reduces the amount of plastic needed to build to a playhouse by roughly 85% so the resulting playhouses are much more environmentally friendly and all of the logs are 100% recyclable.

Building playsets in the real world may be assisted by augmented reality software on a computer platform such as an iPad, so children can build and play with their playsets online, on their own computer, as well as in the real world. The software will allow children to see and walk around their designs viewing their playsets on their computer or phone screens full size as if they already existed in the real world and may include augmented reality software. The program will also provide step by step instructions for constructing the playsets in the real world based on how the children constructed them in the virtual world. The program will provide the optimal list of log cuts so children can make their designs using a minimum number of logs 10 and fasteners 40.

In summary, to use the locking fastener, a child or adult would put the tip 48 of one locking fastener 40 when in the closed or insert position into a portal 20 in a log 10, place another log 10 adjacent to the first log 10, on the other end of the fastener 40 so the other tip 50 of the fastener 40 would pass through a portal 20 in that second log. Continuing this building and fastening technique, the child or adult can build a rather large and sturdy structure. Additional logs can be connected to existing logs or additional panels or other components can be connected to existing logs. The number of combinations of logs and panels is vast since every portal 20 in the logs 10 and every portal 36 in the panel 30 can be used, if possible, with a fastener 40.

Then, by pulling the fastener 40 open or releasing the force keeping it closed, the split arrowhead tips 48, 50 on each end of the fastener 40 will move outward away from each other to create a greater interference fit with the portal 20 then when it was closed. From this open position, it will be very difficult to remove the fastener 40 from the logs 10. In one embodiment, the width of the arrowhead tips 48, 50 is about 1 inch, and the portals 20, 36 are about 0.5 inches. As such, the interference fit with the logs 10 is about 0.5 inches.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein above are also contemplated and within the scope of the disclosed technology.

The invention claimed is:

1. A fastener for a toy construction playset, comprising:

an elongate, unitary body having two parts and a living hinge between said parts extending longitudinally between opposite ends of said body, said parts defining an arrowhead tip at at least one end when in an expanded state, said tip being formed by a barb on each of said parts that extend in opposite directions relative to said hinge; and a flange on each part, said flanges extending in opposite directions from said hinge, whereby by manipulating said flanges, said barbs are brought against one another to reduce a size of said tip and bring said tip into an insertion state in which it is insertable into a portal of a component of a toy construction playset.

2. The fastener of claim 1, wherein each of the ends of said body has said tip.

3. The fastener of claim 1, wherein said two parts are mirror-image parts.

4. The fastener of claim 1, wherein said body is made of plastic.

5. The fastener of claim 1, wherein said barbs have a triangular shape including an angled wall facing the end of said body at which said barb is located, a bottom wall facing an opposite end of said body and a wall alongside said hinge.

6. The fastener of claim 1, wherein said body includes two elongate walls, one in each of said two parts, said walls being separated from one another to define a channel therebetween, said hinge being at a bottom of said channel.

7. The fastener of claim 6, wherein said parts are pivotable about said hinge to bring said walls of said parts to a position against one another.

8. The fastener of claim 6, wherein each of said flanges extends axially from a respective one of said walls.

9. The fastener of claim 1, wherein said flanges are in an approximate middle region of each of said parts.

10. A toy construction playset, comprising:

at least one log or panel having a plurality of portals; and at least one fastener, each of said at least one fastener including an elongate, unitary body having two parts defining an arrowhead tip at each end when in an expanded state, a living hinge between said parts extending longitudinally between opposite ends of said body, and a flange on each part, said flanges extending in opposite directions from said hinge, said tip being formed by a barb on each of said parts that extend in opposite directions relative to said hinge, whereby by manipulating said flanges, said barbs are brought against one another to reduce a size of each of said tips and bring said tips into an insertion state in which each is insertable into a respective one of said portals of said at least one log or panel.

11. The toy construction playset of claim 10, wherein said two parts of each of said at least one fastener are mirror-image parts.

12. The toy construction playset of claim 10, wherein said body of each of said at least one fastener is made of plastic.

13. The toy construction playset of claim 10, wherein said barbs of each of said at least one fastener have a triangular shape including an angled wall facing the end of said body at which said barb is located, a bottom wall facing an opposite end of said body and a wall alongside said hinge.

14. The toy construction playset of claim 10, wherein said body of each of said at least one fastener includes two elongate walls, one in each of said two parts, said walls being separated from one another to define a channel therebetween, said hinge being at a bottom of said channel.

15. The toy construction playset of claim 14, wherein said parts of each of said at least one fastener are pivotable about said hinge to bring said walls of said parts to a position against one another.

16. The toy construction playset of claim 14, wherein each of said flanges of each of said at least one fastener extends axially from a respective one of said walls.

17. The toy construction playset of claim 10, wherein said flanges of each of said at least one fastener are in an approximate middle region of each of said parts.

18. The toy construction playset of claim 10, wherein said at least one log or panel comprises a plurality of logs, said fastener securing a first one of said logs to a second one of said logs.

19. The toy construction playset of claim 10, wherein said at least one log or panel comprises a log and a panel, said fastener securing said log to said panel.

* * * * *